US007121645B2

(12) United States Patent
Hara

(10) Patent No.: US 7,121,645 B2
(45) Date of Patent: Oct. 17, 2006

(54) INK JET PRINTING APPARATUS

(75) Inventor: Katsushi Hara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 354 days.

(21) Appl. No.: 10/768,133

(22) Filed: Feb. 2, 2004

(65) Prior Publication Data

US 2004/0150692 A1 Aug. 5, 2004

(30) Foreign Application Priority Data

Feb. 5, 2003 (JP) ..... 2003-028816

(51) Int. Cl.
*B41J 2/165* (2006.01)

(52) U.S. Cl. ..... 347/30; 347/23

(58) Field of Classification Search ..... 347/30
See application file for complete search history.

(56) References Cited

U.S. PATENT DOCUMENTS 5,896,143 A * 4/1999 Matsui et al. ..... 347/24
5,903,287 A 5/1999 Ishikawa et al. ..... 347/24

FOREIGN PATENT DOCUMENTS

JP 7-32599 2/1995

OTHER PUBLICATIONS

U.S. Appl. No. 10/690,516, filed Oct. 23, 2003.

* cited by examiner

*Primary Examiner*—Stephen Meier
*Assistant Examiner*—Ly T. Tran
(74) *Attorney, Agent, or Firm*—Fitzpatrick, Cella, Harper & Scinto

(57) ABSTRACT

When there are two kinds of caps that protect nozzle faces of print heads—a protective cap with no suction mechanism and a suction cap with a suction mechanism—and if a time during which the print heads are left idle is within a predetermined time, each print head protected by the protective cap performs 5,000 idle ejections during the idle ejection operation executed prior to initiating a printing operation. Each print head protected by the suction cap performs 100 idle ejections during the idle ejection operation. By setting the number of idle ejections for print heads protected by the protective caps to be greater, it is possible to keep all the print heads in good condition at all times whether they are protected by the suction caps or protective caps.

4 Claims, 26 Drawing Sheets

| | IDLE TIME<T4 | T4<IDLE TIME<T3 | T3<IDLE TIME |
|---|---|---|---|
| NUMBER OF IDLE EJECTIONS FROM PRINT HEAD PROTECTED BY PROTECTIVE CAP | 100 | 5000 | 5000 |
| NUMBER OF IDLE EJECTIONS FROM PRINT HEAD PROTECTED BY SUCTION CAP | 100 | 100 | 5000 |

FIG.6

| | IDLE TIME<T4 | T4<IDLE TIME<T3 | T3<IDLE TIME |
|---|---|---|---|
| NUMBER OF IDLE EJECTIONS FROM PRINT HEAD PROTECTED BY PROTECTIVE CAP | 100 | 5000 | 5000 |
| NUMBER OF IDLE EJECTIONS FROM PRINT HEAD PROTECTED BY SUCTION CAP | 100 | 5000 | 5000 |

FIG.7

| | IDLE TIME<T4 | T4<IDLE TIME<T3 | T3<IDLE TIME |
|---|---|---|---|
| NUMBER OF IDLE EJECTIONS FROM PRINT HEAD PROTECTED BY PROTECTIVE CAP | 100 | 100 | 5000 |
| NUMBER OF IDLE EJECTIONS FROM PRINT HEAD PROTECTED BY SUCTION CAP | 100 | 100 | 5000 |

FIG.8

| | DRIVE PULSE DURATION (μsec) |
|---|---|
| DRIVE PULSE DURATION FOR PRINT HEAD PROTECTED BY PROTECTIVE CAP | 2.5 |
| DRIVE PULSE DURATION FOR PRINT HEAD PROTECTED BY SUCTION CAP | 2.0 |

FIG.9

| | IDLE TIME<D2 | D2<IDLE TIME<D1 | D1<IDLE TIME |
|---|---|---|---|
| INK VOLUME SUCKED OUT FROM PRINT HEAD PROTECTED BY PROTECTIVE CAP | V1 | V2 | V2 |
| INK VOLUME SUCKED OUT FROM PRINT HEAD PROTECTED BY SUCTION CAP | V1 | V1 | V2 |

FIG.23

| | IDLE TIME<D2 | D2<IDLE TIME<D1 | D1<IDLE TIME |
|---|---|---|---|
| INK VOLUME SUCKED OUT FROM PRINT HEAD PROTECTED BY PROTECTIVE CAP | V1 | V2 | V2 |
| INK VOLUME SUCKED OUT FROM PRINT HEAD PROTECTED BY SUCTION CAP | V1 | V2 | V2 |

FIG.24

| | IDLE TIME<D2 | D2<IDLE TIME<D1 | D1<IDLE TIME |
|---|---|---|---|
| NUMBER OF SUCTION OPERATIONS FOR PRINT HEAD PROTECTED BY PROTECTIVE CAP | 1 | 2 | 2 |
| NUMBER OF SUCTION OPERATIONS FOR PRINT HEAD PROTECTED BY SUCTION CAP | 1 | 1 | 2 |

FIG.25

INK JET PRINTING APPARATUS

This application claims priority from Japanese Patent Application No. 2003-028816 filed Feb. 5, 2003, which is incorporated hereinto by reference.

BACKGROUND OF THE INVENTION

1. Field of the Invention

The present invention relates to an ink jet printing apparatus with a protective mechanism for preventing a clogging of nozzles and ink ejection anomalies in a print head.

2. Description of the Related Art

As recording apparatus (or printing apparatus) with a function of printer, copying machine or facsimile, or as printing apparatus used as output devices for composite electronic devices including computers and word processors as well as for workstations, ink jet printing apparatus, which execute printing by ejecting ink onto a print medium (print material), such as paper, cloth, plastic sheet and OHP sheet, according to image information (print information), have become more widespread.

There are growing demands that printing apparatus print on a variety of print materials. To meet these demands, development efforts have been made in recent years and printing apparatus are now available which use as print media cloth, leather, nonwoven cloth and metals in addition to ordinary print media such as paper (including thin paper and processed sheet) and thin resin sheet (OHP sheet).

The ink jet printing apparatus, which ejects liquid ink from a print head as a printing means onto a print medium to form an image thereon (i.e., performs printing), has many features, such as an ease with which the apparatus size can be reduced and an ability to print a full color image. There is a trend in recent years for an increased number of ink colors (ink kinds) used, as a result of adding light-colored inks for reducing a graininess and special color inks for widening a color reproduction range in addition to four colors, cyan, magenta, yellow and black, the minimum required for full color printing. It has also been proposed to use a plurality of print heads for each color to increase the printing speed. Against this technical background in recent years, the number of print heads mounted on the ink jet printing apparatus has tended to increase.

A nozzle face of the print head is normally covered with a cap when a printing operation is not performed because directions and volumes of ink ejections are affected by dirt adhering to ink ejection openings or by ink near the nozzle openings being evaporated. Further, various recovery mechanisms for recovering a normal state of the print head are provided, which include a suction mechanism that sucks out viscous ink from the nozzle openings in a capped state and a preliminary ejection mechanism that performs preliminary ejections (also referred to as "idle ejections") in the capped state. The number of capping means including the cap and the recovery mechanisms tend to increase with the increasing number of the print heads used.

As the number of capping means increases, another construction is proposed in which, rather than providing all the caps with the suction mechanism, the suction mechanism is used on only a part of the caps, with the remaining caps serving as protective caps that cover the nozzle faces of the print heads (Japanese Patent Application Laid-open No. 7-032599 (1995)). For suction operation, each of the print heads is moved to the suction cap that has the suction mechanism. By setting the number of suction caps less than the number of the print heads, the cost and size of the printing apparatus can be reduced.

With this construction, however, while the suction cap maintains a proper level of moisture in it at all times by the suction of ink, the interior of the protective cap with no suction mechanism is not moist enough to prevent the nozzle face from becoming dry It is therefore difficult to maintain a highly reliable ejection performance for the nozzles capped with the protective cap.

Since the ink jet printing apparatus perform printing by ejecting ink from minute nozzles, the nozzles may get clogged with ink, resulting in ink ejection anomalies (including ejection failures) and therefore a degraded quality of printed image. To prevent this some ink jet printing apparatus perform an ejection recovery operation to maintain or reinstate a normal ink ejection performance of the printing means. Two examples of such ejection recovery operations are described below.

A first example involves ejecting ink from all nozzles of the print head onto an area outside an image forming area (referred to as an "idle ejection operation") to prevent possible ejection failures caused by an increased ink viscosity due to characteristic changes with the passage of time.

A second example involves providing the print head protective capping means with a forced flow producing means, such as a pump, to cause ink present near the nozzle openings in all print heads to flow in order to remove viscous ink, which is formed after the apparatus has been left idle for a long period of time, from near the nozzle openings and to remove dirt or foreign substances that adhere to the nozzle openings and may cause ink ejection failures.

In conventional practice, these recovery operations have been executed periodically to keep the nozzle face clean.

Adopting the above-described first and second method in the ink jet printing apparatus, which has only a part of the caps function as a suction cap, to perform the similar ejection recovery operation on all print heads, however, has the following problems.

With the first method, because a protective cap with no suction mechanism is not moist inside, a print head protected by the protective cap when not used has an ink viscosity change faster than does the print head protected by a suction cap with the suction mechanism, and therefore requires idle ejections prior to printing even after a short period of rest. If all the print heads protected by the protective caps are to perform idle ejections required after a short period of rest, this results in the print head protected by the suction cap performing the idle ejections too often and therefore wasting ink through more than necessary idle ejections.

As to the second method, because the protective cap as described above is not moist inside, a print head protected by the protective cap when not used has an ink viscosity change faster than does the print head protected by a suction cap with the suction mechanism. If printing is to be performed after the print head has been left idle for a longer period of time than in the first method, a print head protected by a protective cap may not be able to eject ink normally unless a forced ink flow is produced in the print head prior to the start of printing operation. On the other hand, a print head protected by a suction cap may be able to eject ink normally without having to cause a forced ink flow in the print head. Therefore, if the similar forced ink flow is produced in all the print heads, the print head protected by the suction cap will have a time loss due to the unnecessary, forced ink flow and an increased volume of waste ink.

SUMMARY OF THE INVENTION

The present invention has been accomplished to overcome the aforementioned technical problems and it is an object of the present invention to provide an ink jet printing apparatus with a plurality of print heads, in which even those print heads whose nozzle faces are protected by protective caps with no suction mechanism can eliminate possible nozzle clogging and ink ejection anomalies or failures and maintain a highly reliable ejection performance without entailing a significant increase in cost or an apparatus size increase.

In one aspect, the present invention provides an ink jet printing apparatus which comprises; a suction means for sucking out ink from nozzles of the print head, a suction cap for protecting a nozzle face of the print head, the suction cap being connected to the suction means, a protective cap for protecting a nozzle face of the print head, the protective cap being not connected to the suction means, and an ejection recovery means for differentiating an ejection recovery operation between the print head protected by the suction cap and the print head protected by the protective cap.

In the above construction, a nozzle face of the print head protected by the suction cap means is moist, when compared with the print head protected by the protective cap other than the suction cap, and its ink degradation rate is slow. Thus, differentiating the ejection recovery operation between the different types of print heads enables optimal ejection recovery processing to be performed on individual print heads.

The above and other objects, effects, features and advantages of the present invention will become more apparent from the following description of embodiments thereof taken in conjunction with the accompanying drawings.

BRIEF DESCRIPTION OF THE DRAWINGS

FIG. 6 is a table showing a relation between a time of rest and the number of idle ejections;

FIG. 7 is a table showing a relation between a time of rest and the number of idle ejections in a conventional printing apparatus;

FIG. 8 is a table showing a relation between a time of rest and the number of idle ejections in a second embodiment of this invention;

FIG. 9 is a table showing a drive pulse duration for each print head in the second embodiment;

FIG. 23 is a table showing a relation between a time of rest and a volume of ink sucked out for ejection recovery;

FIG. 24 is a table showing a relation between a time of rest and a volume of ink sucked out for ejection recovery in a conventional printing apparatus;

FIG. 25 is a table showing a relation between a time of rest of the print head and the number of times that the suction-based recovery operation needs to be carried out.

DETAILED DESCRIPTION OF PREFERRED EMBODIMENTS

Embodiments of the present invention will be described by referring to the accompanying drawings.

(Embodiment 1)

Figure 1:
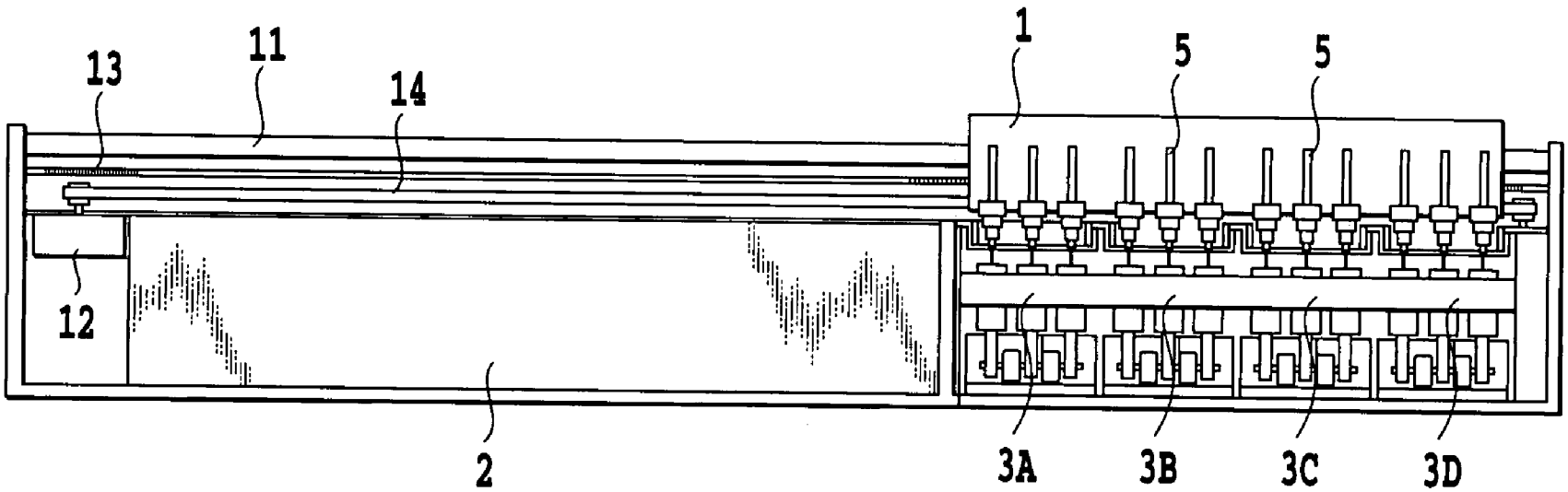
FIG. 1 is a cross-sectional view of an ink jet printing apparatus as one embodiment of the present invention.

FIG. 1 is a schematic front cross-sectional view of an ink jet printing apparatus as one embodiment of this invention.

Denoted 1 is carriage; 2 an apparatus body including a paper transport unit; 3A, 3B, 3C and 3D recovery mechanisms for maintaining and reinstating a normal ink ejection performance of the print heads as printing means; and 5 print heads as printing means. The carriage 1 is movably supported along a guide shaft 11 and reciprocally moved by a driving force transmitted from a carriage motor 12 through a belt 14.

When the apparatus body receives print data, the carriage 1 is controlled to scan along the guide shaft 11 to print on a print medium fed by the paper transport unit (not shown). Near the carriage 1 is arranged an encoder film 13 which is read by an encoder mounted on the carriage 1 to detect an absolute position of the carriage 1. Based on the encoder's position detection, a home position of the carriage 1 is set (in this embodiment, at a position facing the recovery mechanisms).

Figure 2:
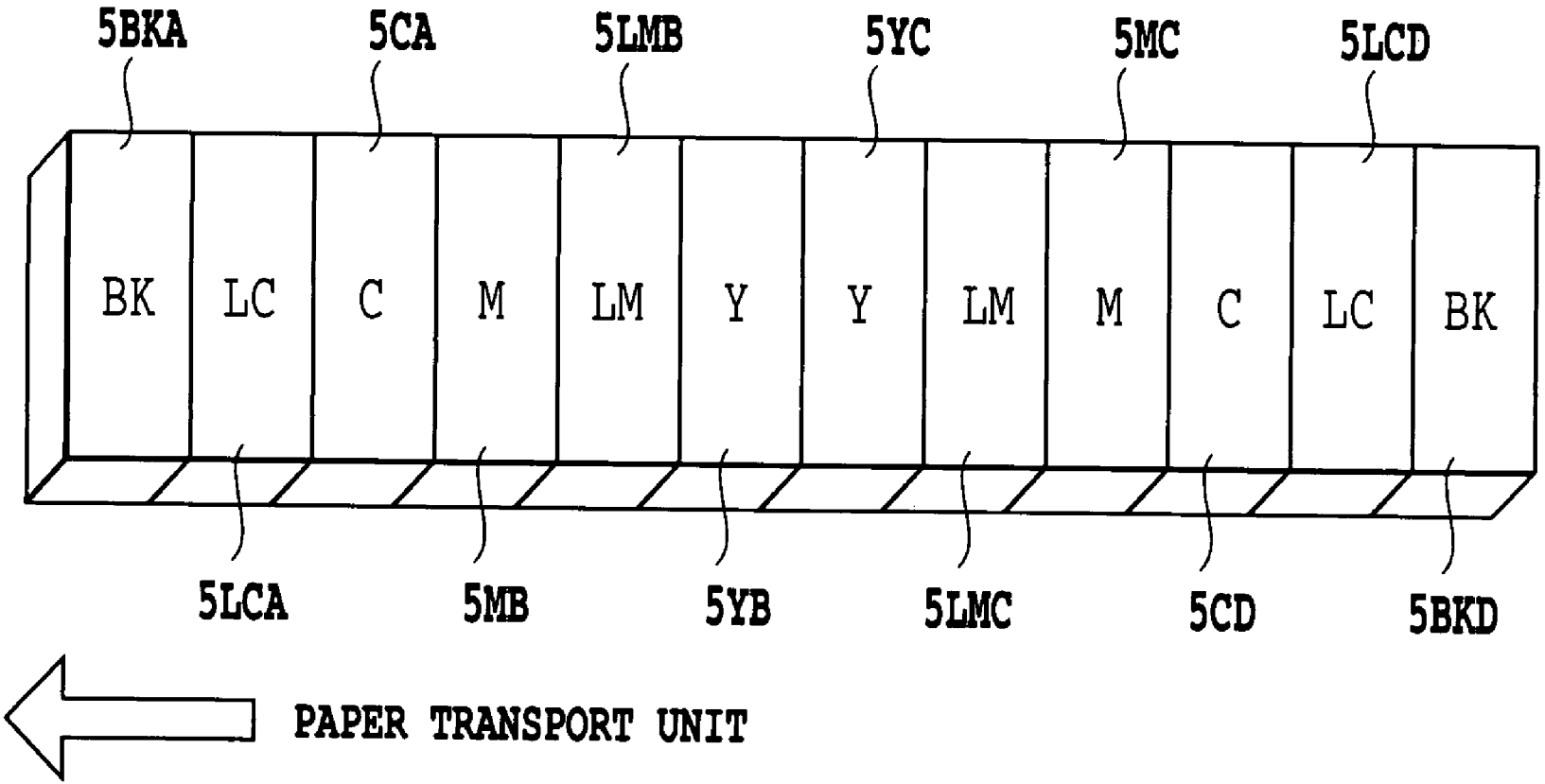
FIG. 2 is a schematic view showing a construction of a print head.

FIG. 2 is a schematic view showing a construction of the print heads 5 as printing means. FIG. 2 represents a state in which the carriage 1 is standing by at its home position and print heads—black head 5BKA, light cyan head 5LCA, cyan head 5CA, magenta head 5MB, light magenta head 5LMB, yellow head 5YB, yellow head 5YC, light magenta head 5LMC, magenta head 5MC, cyan head 5CD, light cyan head 5LCD and black head 5BKD—are arranged in that order from a side near the transport unit toward a side remote from the unit. As for the inks used, a total of six colors (six kinds) of ink are used which, in addition to four basic colors—cyan, magenta, yellow and black—includes light-colored inks to reduce graininess. In the example shown, two print heads are assigned to each ink color to improve the printing speed, with a total of 12 print heads mounted on the carriage.

Each of the print heads 5 ejects ink by using a thermal energy and has electrothermal transducers for generating the thermal energy. More specifically, the print heads perform printing by causing a film boiling in ink by the thermal energy generated by the electrothermal transducers and using a pressure change produced by an expansion and contraction of bubbles to eject ink from nozzles.

Figure 26:
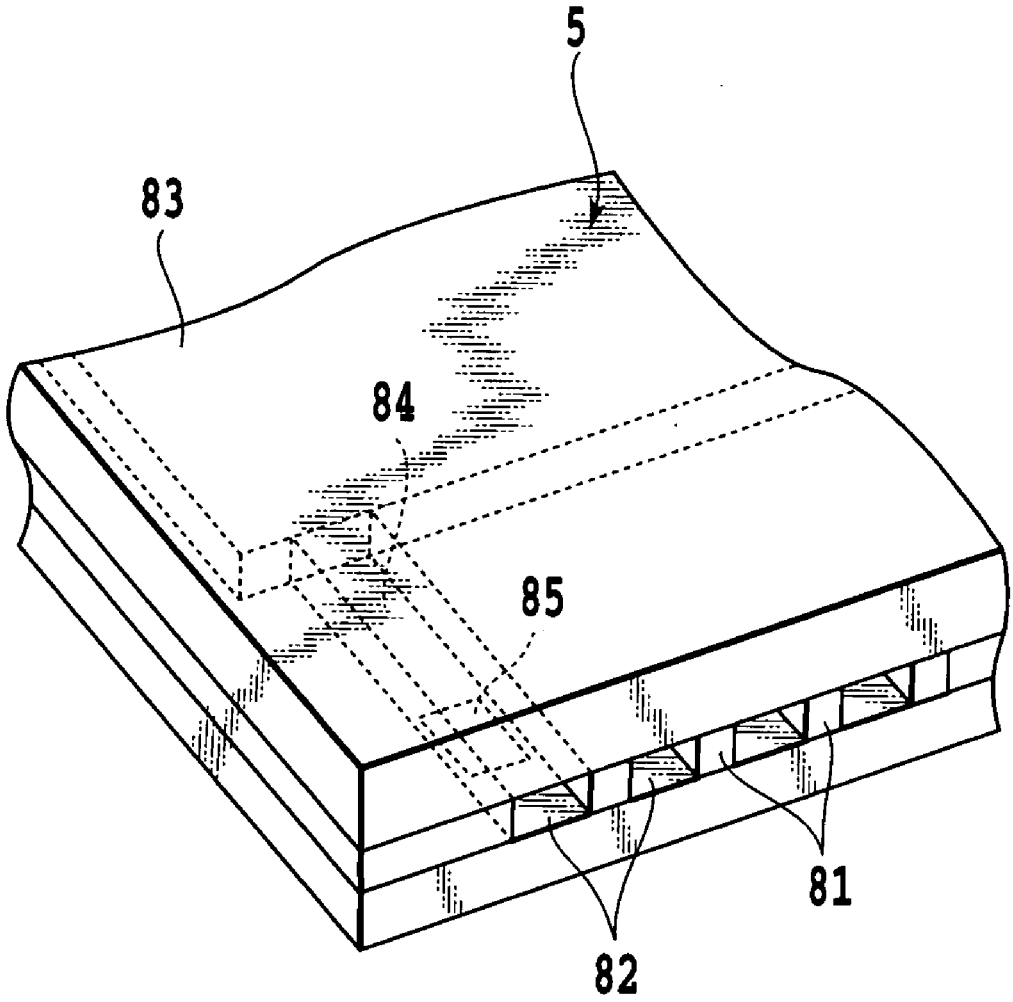
FIG. 26 is a partial perspective view schematically showing a construction of an ink ejection portion of the print head.

FIG. 26 is a partial perspective view showing a construction of an ink ejection portion of one print head.

In a nozzle face 81 facing a print medium with a clearance (e.g., about 0.2–2.0 millimeters) in between, a plurality of nozzles 82 are formed at a predetermined pitch. An electrothermal transducer 85 to generate an energy for ejecting ink is arranged along each of liquid paths 84 that communicate a common liquid chamber 83 with each nozzle 82. The print heads are mounted on the carriage 1 so that they are arranged in a direction (referred to as a "subscan direction") crossing a direction in which the print heads and the carriage are moved (referred to as a "main scan direction"). Based on image signal or ejection signal, the corresponding electrothermal transducers 85 in the print heads are driven to film-boil the ink in the liquid paths 84 to generate bubbles and eject ink from the nozzles 82 by pressure generated by the bubbles.

The recovery mechanism to maintain and reinstate a normal ink ejection performance of the 12 print heads of FIG. 2 comprises four recovery mechanisms 3A, 3B, 3C, 3D (see FIG. 1). The recovery mechanism 3A is used to recover three print heads 5BKA, 5LCA, 5CA. The recovery mechanism 3B is assigned to recovering three print heads 5MB, 5LMB, 5YB. The recovery mechanism 3C is assigned to recovering three print heads 5YC, 5LMC, 5MC. The recovery mechanism 3D is intended for use with three print heads 5CD, 5LCD, 5BKD. These four recovery mechanisms 3A, 3B, 3C, 3D have virtually the same construction. The following explanation centers mainly on the recovery mechanism 3A as a representative case which is situated closest, among the four recovery mechanisms, to the transport unit.

Figure 3:
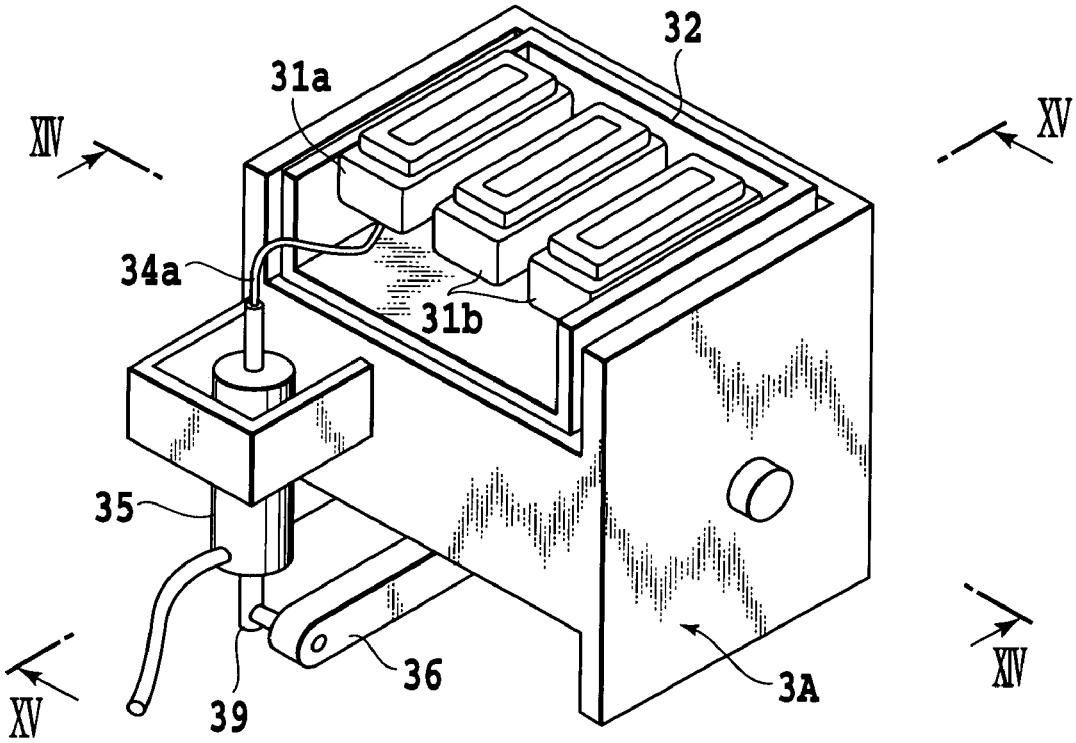
FIG. 3 is a perspective view showing schematically a construction of a recovery mechanism.

FIG. 3 is a schematic perspective view showing a construction of the recovery mechanism 3A. In FIG. 3, reference number 31*a* represents a suction cap, 31*b* a protective cap, 32 a cap holder, 35 a pump (suction pump making up a suction mechanism), and 36 a lever to activate the pump.

In an ink jet printing apparatus, when it is left idle, a volatile component in ink evaporates from nozzles increasing the ink viscosity. When the ink viscosity exceeds an upper limit of allowable viscosity at which the ink can be ejected from the print head, an ink ejection failure results. To avoid this phenomenon, the following ink ejection failure prevention means is provided.

Figure 4:
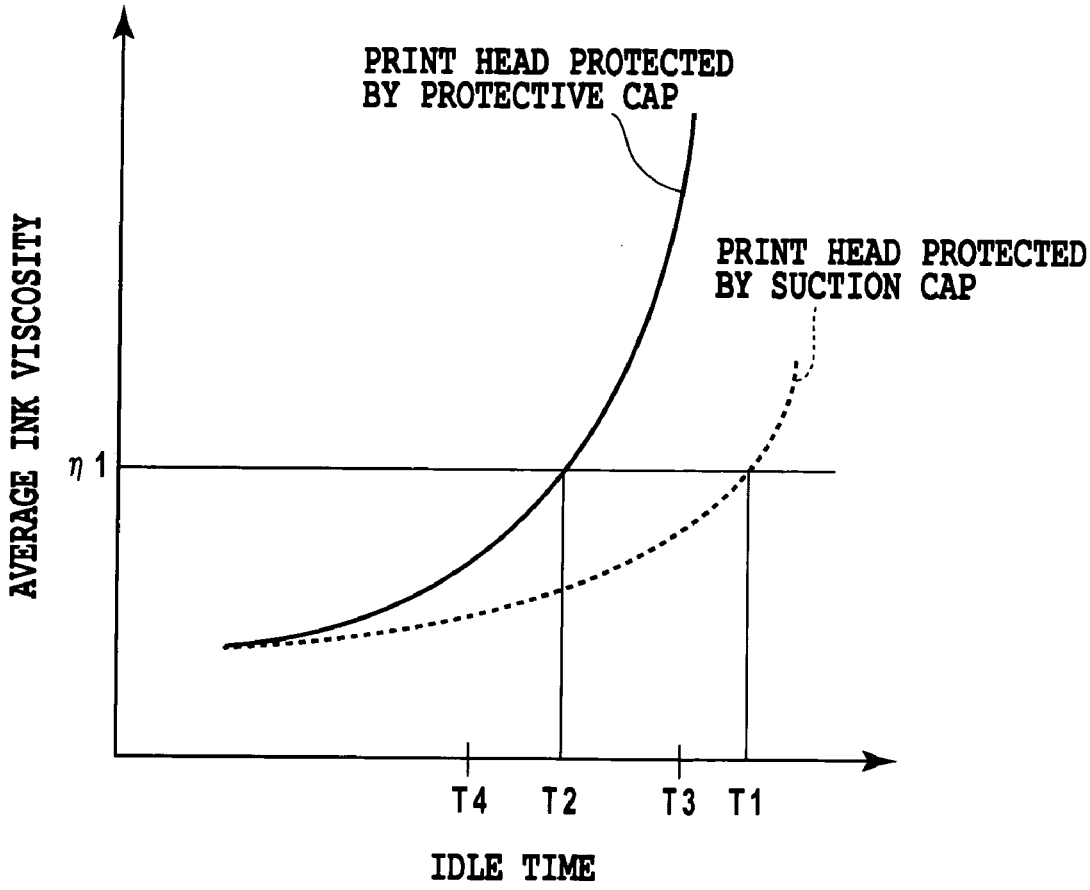
FIG. 4 is a graph showing a relation between a time of rest and an average ink viscosity.

FIG. 4 is a graph showing a relation between a time of rest and an average ink viscosity.

As indicated by a dashed line, a rate of change of the average ink viscosity in a print head protected by a suction cap is moderate. After a time of rest T1, the ink in the print head protected by the suction cap reaches an upper limit viscosity $\eta 1$ through evaporation of the volatile component. If left unused longer, the print head may not be able to eject ink properly. Therefore, when a printing operation is resumed after a rest time T3 of FIG. 4, which is shorter than T1; the print head protected by the suction cap can eject ink in a proper condition without having to perform the recovery operation in advance.

As for the ink in a print head protected by a protective cap, its volatile component rapidly evaporates and the ink viscosity changes more rapidly than that of the print head protected by the suction cap, as indicated by a solid line of FIG. 4. The upper limit of the allowable viscosity $\eta 1$ is reached after a rest time T2, which is shorter than T1 for the print head protected by the suction cap. Therefore, when the printing operation is resumed after a rest time T4 of FIG. 4, shorter than T2, the print head can eject ink properly without performing the recovery operation in advance. However, when resuming the printing operation after a rest time T3, which is longer than T2, the print head cannot eject ink properly without performing the recovery operation in advance.

In this embodiment, therefore, in order to have these print heads perform appropriate idle ejections by differentiating the idle ejection initiation time and the number of idle ejections between the print head protected by the suction cap and the print head protected by the protective cap, idle ejection control circuits for these print heads are separated.

Figure 5:
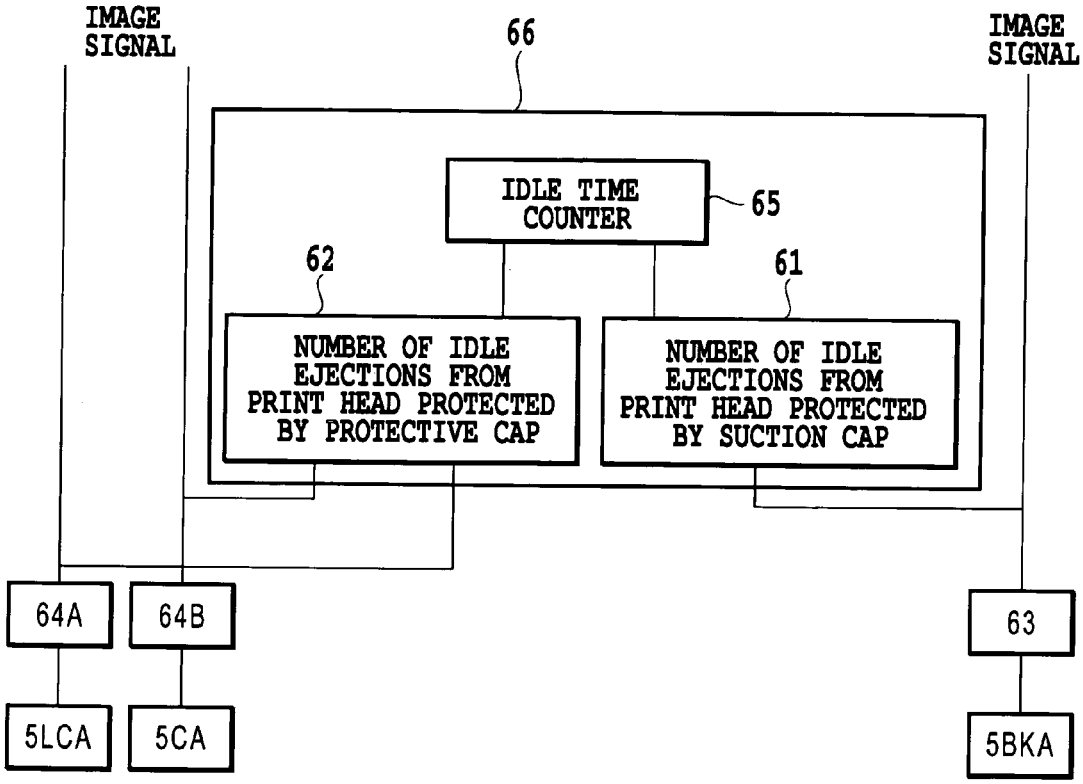
FIG. 5 is a schematic diagram showing an idle ejection mechanism.

FIG. 5 is a schematic diagram showing an idle ejection operation mechanism in this embodiment.

In this embodiment, an idle ejection control circuit is divided into an idle ejection control circuit 61 for the head 5BKA protected by a suction cap and an idle ejection control circuit 62 for the print heads 5LCA and 5CA protected by protective caps.

Prior to initiating a printing operation after a longer period of rest than the rest time T3, the idle ejection control circuit 61 on the suction cap side drives a drive circuit 63 for the print head 5BKA protected by the suction cap to cause the print head 5BKA to idle-eject ink onto an area on a print medium outside an image forming area. As for the print heads 5LCA and 5CA protected by the protective caps, prior to initiating a printing operation after a longer period of rest than T4, the idle ejection control circuit 62 drives drive circuits 64A and 64B to cause these print heads to idle-eject ink onto an area on a print medium outside the image forming area. Denoted 65 is a timer for counting a period of time during which the printing apparatus has been left idle. Based on the counted time, the control circuits 61 and 62 are operated when the rest times T3 and T4 are exceeded.

As shown in FIG. 6, when the reset time is more than T4 and less than T3, the number of idle ejections performed by the print head protected by the protective cap is 5000 ejections, whereas the print head protected by the suction cap need only perform 100 idle ejections. That is, when the rest time is between T4 and T3, the ink in the print head protected by the protective cap has already reached a level of viscosity that renders a proper ink ejection difficult but the ink in the print head protected by the suction cap has not reached the upper limit of allowable viscosity. Thus, the print head on the suction cap side does not need as many idle ejections as does the protective head on the protective cap side and the number of its idle ejections is very small.

FIG. 7 shows the number of idle ejections made in the prior art without distinguishing the control between the print head on the suction cap side and the print head on the protective cap side. As described above, when the rest time is more than T4 and less than T3, the print head on the suction cap side also performs 5000 idle ejections. Comparison with FIG. 6 suggests that the wasted 4900 idle ejections can be eliminated with this embodiment.

In this embodiment as described above, an ink consumption resulting from wasteful idle ejections can be eliminated by changing the number of idle ejections performed by the print head prior to initiating a printing operation according to the kind of cap protecting the print head under consideration.

(Embodiment 2)

In Embodiment 1 described above, the number of idle ejections is differentiated between the print head protected by the suction cap and the print head protected by the protective cap. The similar effect can be produced by using the same number of idle ejections and differentiating drive conditions for idle ejections. In this embodiment a control that uses the same idle ejection numbers will be explained.

FIG. 8 shows the numbers of idle ejections made by print heads protected by different kinds of caps.

When a rest time is more than T4 and less than T3, the print head protected by the protective cap and the print head protected by the suction cap both perform the same number of idle ejections. But since the print head on the protective cap side has an average ink viscosity higher than $\eta 1$, a control is made to apply a greater ink ejection energy to the print head than that for the print head on the suction cap side to reliably remove ink from the print head on the protective cap side. The print head on the protective cap side that receives a greater ejection energy ejects a larger volume of ink in one ejection action than does the print head on the suction cap side. Thus, the print head on the protective cap side can reliably remove viscous ink even with a smaller number of ejections than used in the previous embodiment.

FIG. 9 shows a duration of an idle ejection drive pulse for a print head protected by a suction cap and a duration of an idle ejection drive pulse for a print head protected by a protective cap. The pulse duration for the print head on the protective cap side is longer than that for the print head on the suction cap side. Thus the print head on the protective cap side can receive a greater ink ejection energy.

As described above, this embodiment makes it possible to eliminate an ink consumption resulting from wasteful idle ejections by changing the method of idle ejection of ink from the print head, performed prior to initiating a printing operation, according to the kind of cap used to protect the print head. Further, in the print head described above, a large ink ejection energy may be obtained, for example, by dividing the drive pulse for the electrothermal transducers 85 or increasing a voltage of the drive pulse. Another method of forcing out viscous ink near nozzle openings from the print head protected by the protective cap involves generating heat from the electrothermal transducers 85 much more rapidly than in the print head protected by the suction cap. This may be achieved, for example, by applying about 1,000 idle ejection drive pulses per second to the print head protected by the suction cap and performing idle ejections for a duration of 0.1 second and, for the print head protected by the protective cap, by applying about 10,000 idle ejection drive pulses per second and performing idle ejections for a duration of 0.01 second.

(Embodiment 3)

In Embodiment 1 and Embodiment 2, the number of idle ejections performed and the idle ejection drive conditions are changed depending on whether the print head used is protected by a suction cap or protective cap. The similar effect can also be produced by using the same number of idle ejections and the same idle ejection drive condition and differentiating idle ejection patterns.

Figure 10:
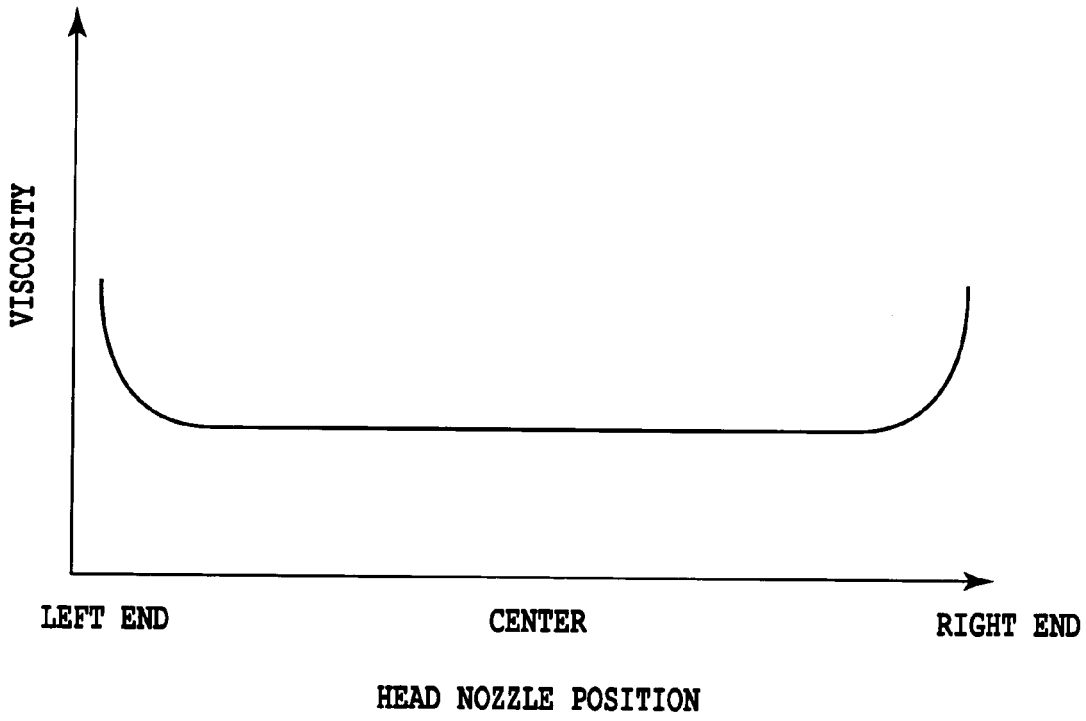
FIG. 10 is a graph showing a relation between an ink viscosity and a head nozzle position.
Figure 11:
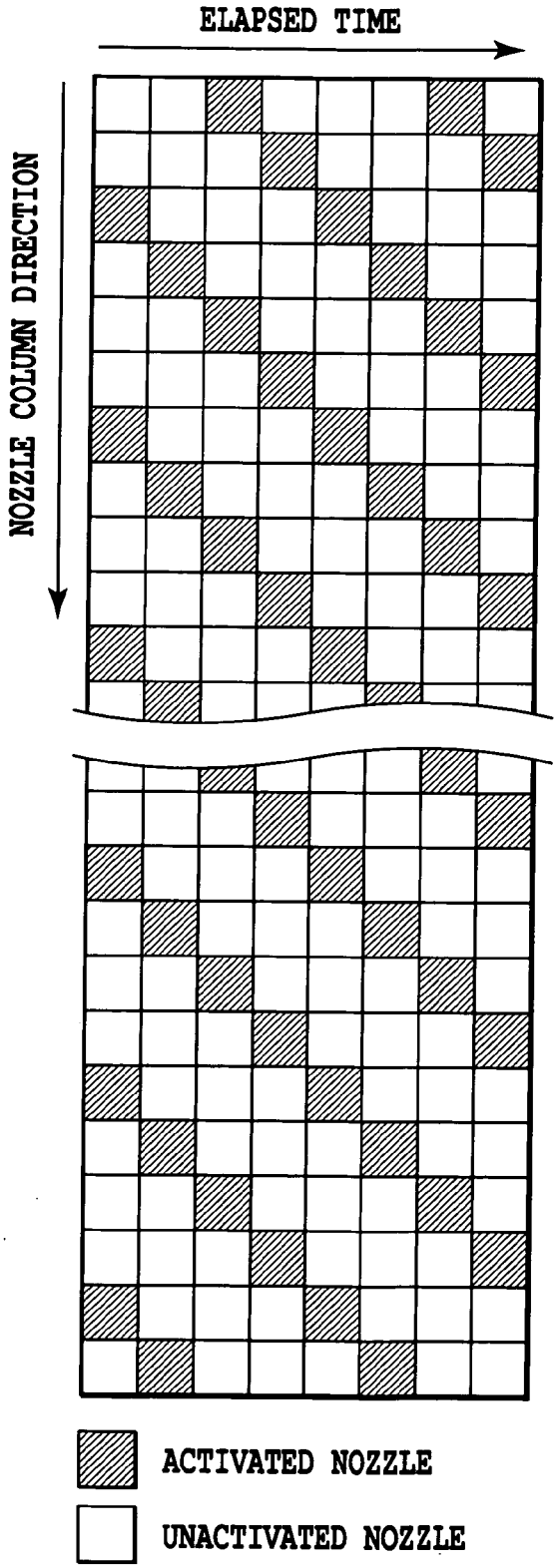
FIG. 11 is a pattern diagram representing a uniform ejection pattern.
Figure 12:
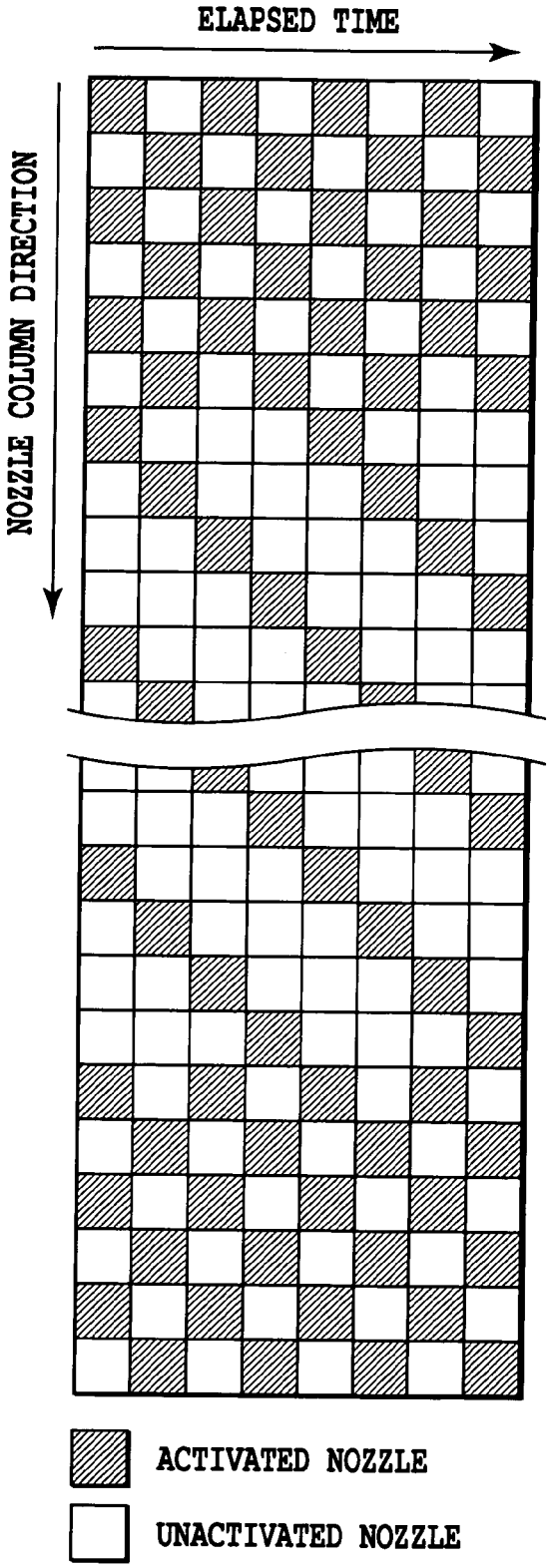
FIG. 12 is a pattern diagram representing an ejection pattern when nozzles with high viscosity are driven concentratedly.

More specifically, the number of idle ejections is set as shown in FIG. 8 and, for a print head protected by a protective cap, idle ejections are performed in an ejection pattern that ensures reliable ejections of ink even if the average ink viscosity is equal to or higher than $\eta 1$. Ink viscosity after leaving the print head unused for some time is higher at ends of the print head, which are closer to open air, than at the central portion, as shown in FIG. 10. An ejection pattern such as shown in FIG. 12 concentratedly drives the nozzles at the ends of the print head with higher ink viscosities. Therefore, performing idle ejections in the ejection pattern of FIG. 12 can reliably eject even a viscous ink which would be difficult to shoot using a uniform ejection pattern such as shown in FIG. 11.

As described above, in this embodiment, by changing the election pattern in which the print head expels ink prior to a printing operation according to the kind of cap used to protect the print head, a wasteful ink consumption due to unnecessary idle ejection can be eliminated.

(Embodiment 4)

Embodiment 1 differentiates the number of idle ejections performed prior to a printing operation between a print head protected by a suction cap and a print head protected by a protective cap in order to keep the ejection performance of the print head on the protective cap side in as good a condition as the print head on the suction cap side. However, since the interior of the protective cap is not as moist as that of the suction cap, the print head on the protective cap side needs to perform a greater number of idle ejections than the print head on the suction cap side. Hence, in this embodiment, the protective cap is given moisture to make it as moist as the suction cap to produce effects similar to those of the previous embodiments even if the print heads on the protective cap side and on the suction cap side perform the same number of idle ejections.

Figure 13:
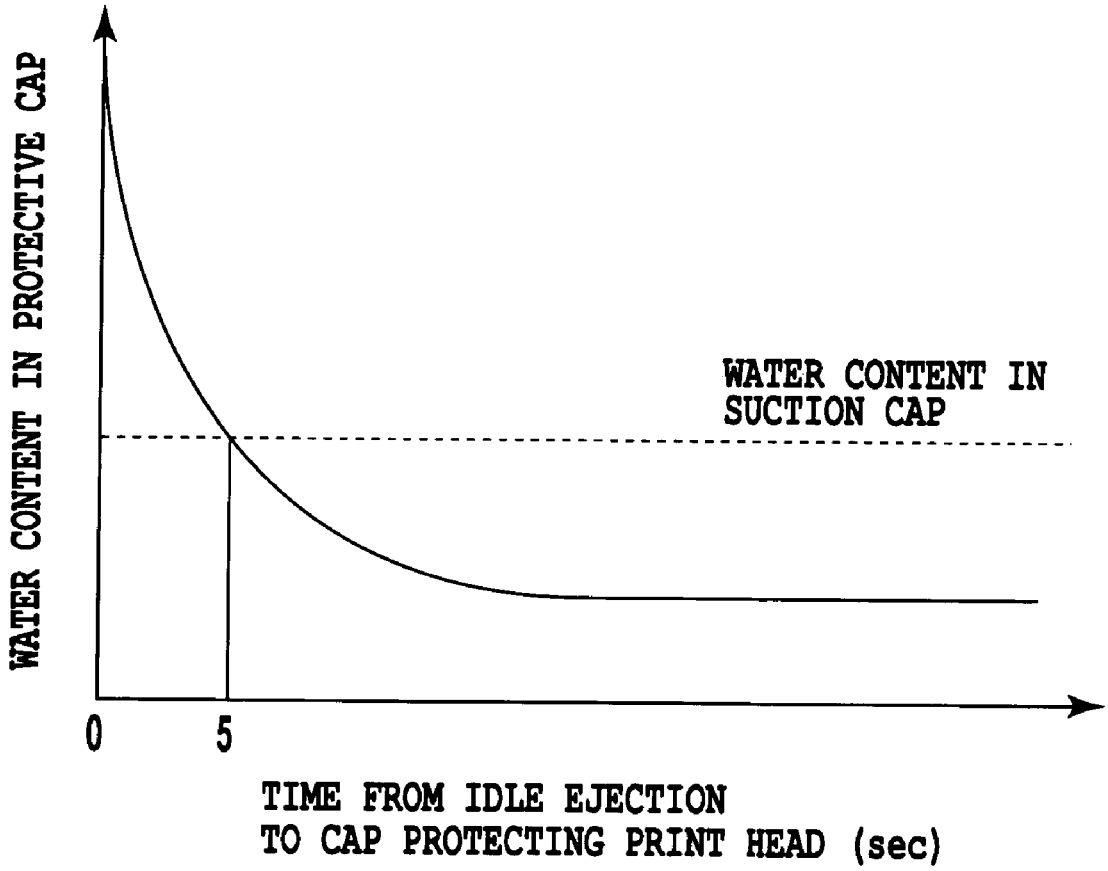
FIG. 13 is a graph showing a relation between a water content in a protective cap and a time that elapses from the execution of idle ejections until the print head is protected by a cap.

FIG. 13 is a graph showing a change in water content after moisture is applied to the protective cap. When the time taken from idle ejections to the print head being capped exceeds five seconds, humidity in the cap evaporates, reducing the water content below that of the suction cap, degrading the capability of keeping the print head moist. It is therefore desired that the print head be capped with the protective cap within five seconds of idle ejections.

In this embodiment as described above, by performing idle ejections immediately before the print head is capped following a printing operation, depending on the kind of cap with which the print head is to be capped, a wasteful consumption of ink due to unnecessary idle ejections can be avoided.

The suction cap may also be subjected to idle ink ejections and the number of idle ejections performed on the protective cap be set larger than that for the suction cap.

It is also possible to perform idle ejections not only after the printing operation but also before initiating the printing operation to increase the moisture keeping capability of the protective cap.

(Embodiment 5)

If a printing apparatus has been left idle for more than three days, water and solvent components in ink vaporize increasing the ink viscosity. If vaporization proceeds further, a dye dissolved in ink may precipitate and adhere to nozzles, clogging them. To remove the adhering substances the following recovery mechanism is constructed.

FIG. 3 is a schematic perspective view showing a construction of a recovery mechanism 3A. Since four recovery mechanisms 3A, 3B, 3C, 3D shown in FIG. 1 have virtually the same construction, the recovery mechanism 3A which is situated closest to the transport unit will be taken up as a representative case in the following description.

Figure 14:
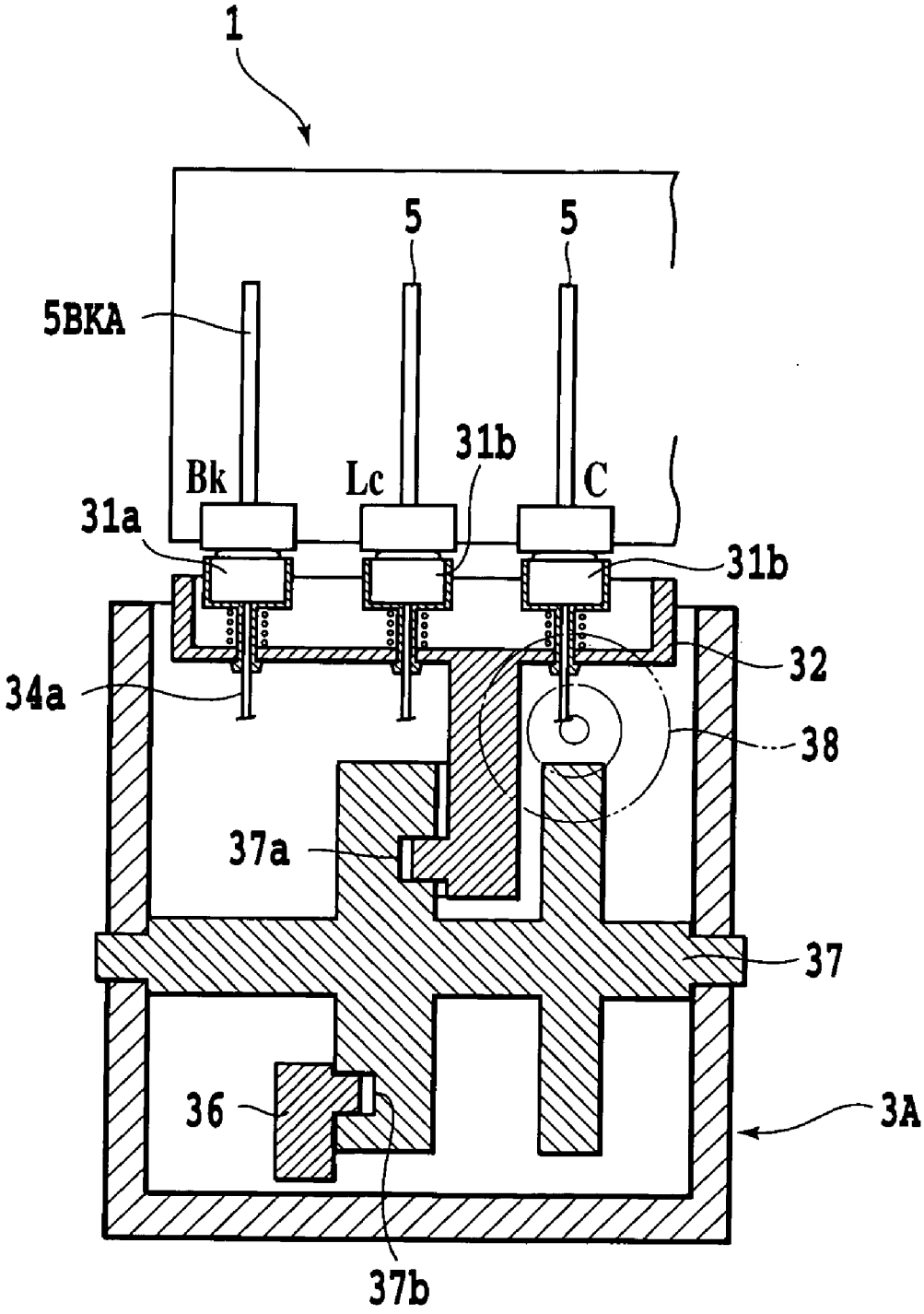
FIG. 14 is a cross-sectional view taken along the line XIV—XIV of FIG. 3.
Figure 15:
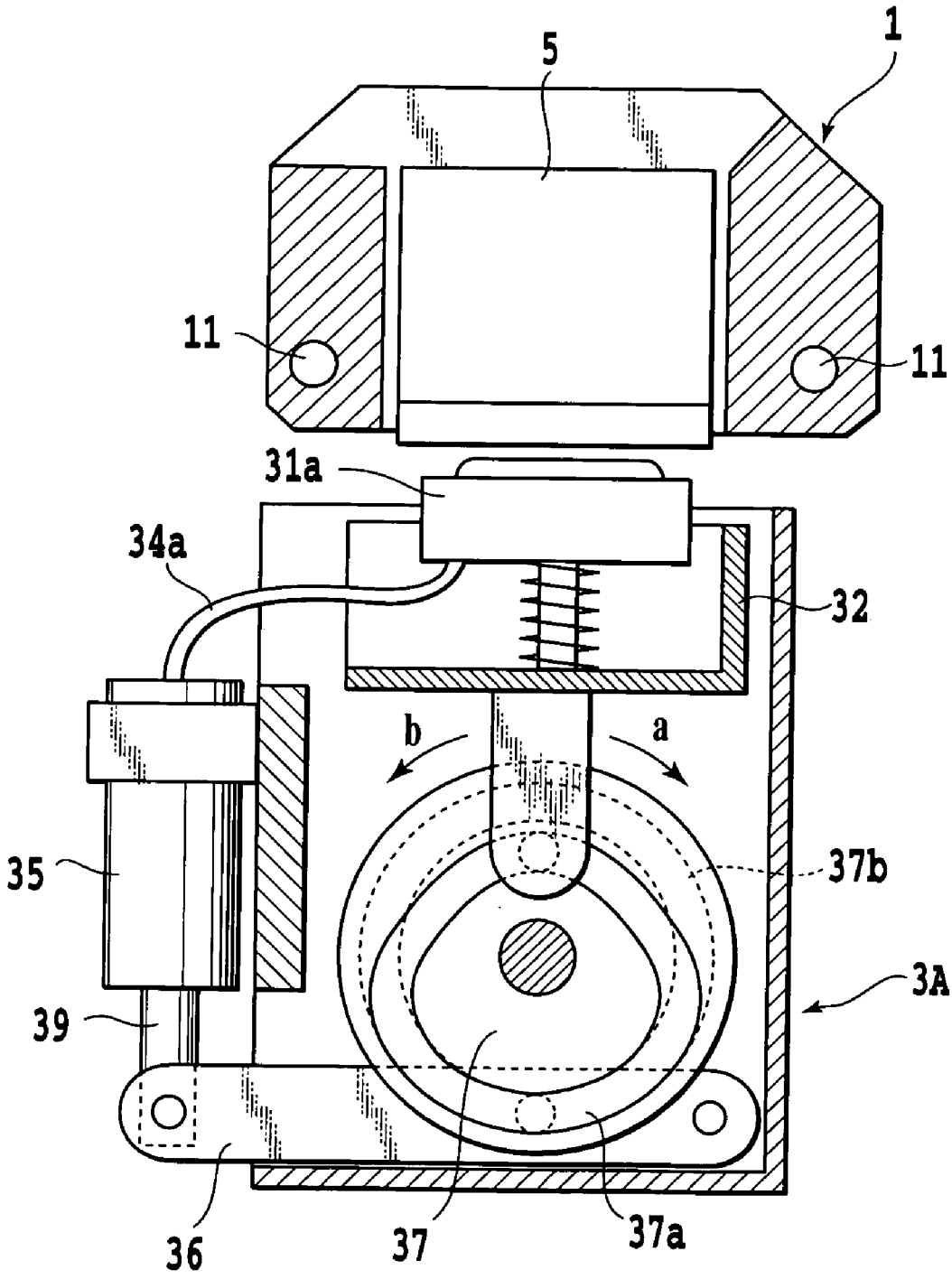
FIG. 15 is a cross-sectional view taken along the line XV—XV of FIG. 3.
Figure 16:
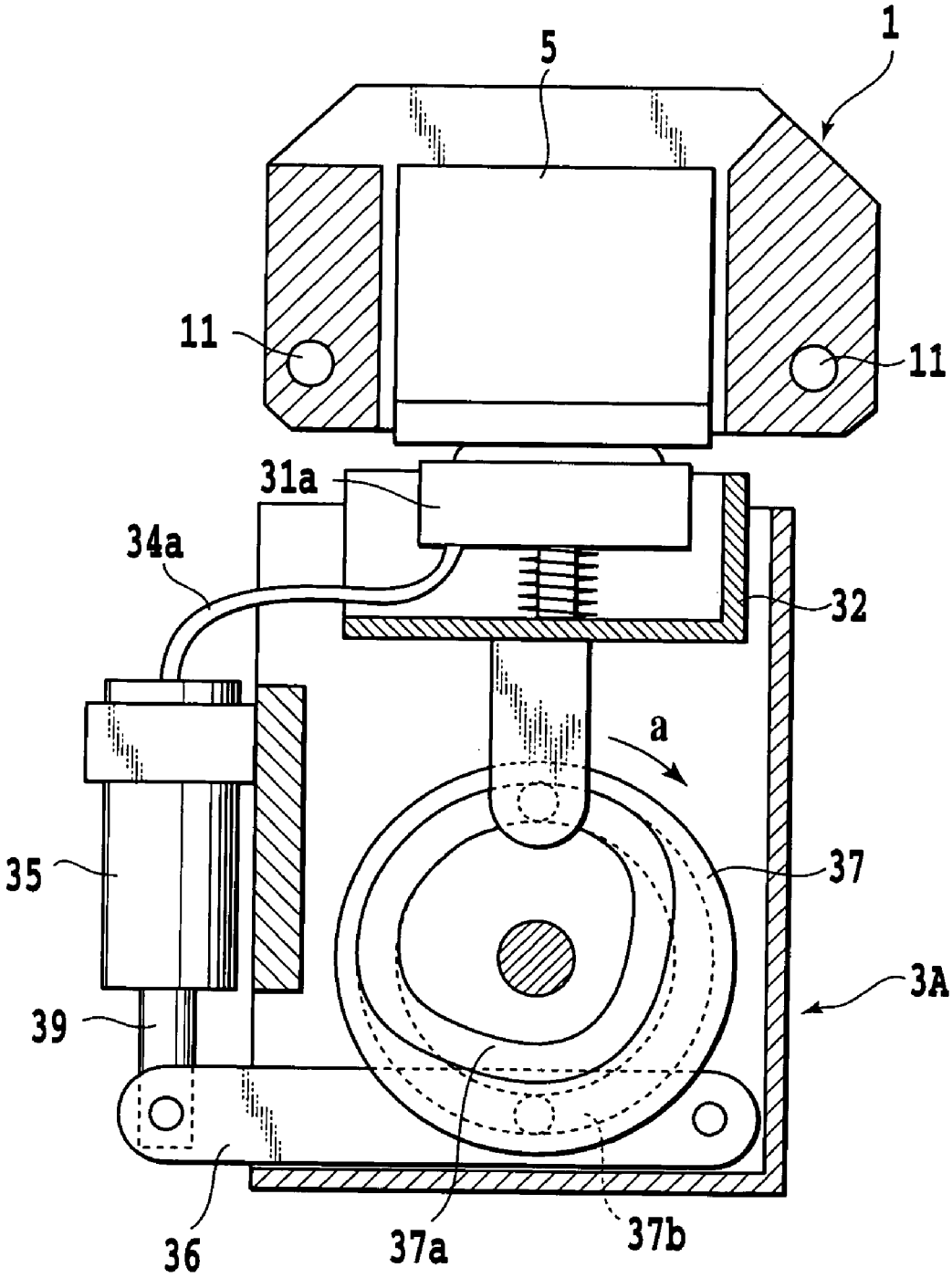
FIG. 16 is a cross-sectional view taken along the line XV—XV of FIG. 3 when the print head is capped without sucking out ink.

FIG. 14 is a cross-section taken along the line XIV—XIV of FIG. 3; FIG. 15 is a cross-section taken along the line XV—XV of FIG. 3 when a cap is open; and FIG. 16 is a cross-section taken along the line XV—XV of FIG. 3 when a print head is capped but with no ink sucking operation performed.

Designated 37 is a cam gear that operates the lever 36. Denoted 38 is a motor (recovery system motor) that drives the cam gear. Of the four recovery mechanisms, the recovery mechanism 3A is situated closest to the paper transport unit (in the example shown, at a position adjoining the side surface of the paper transport unit), as shown in FIG. 1.

The home position of the carriage 1 is set at a position where the three print heads 5BKA. 5LCA, 5CA (three on the left side in FIG. 2) on the carriage 1 rest facing three caps of the recovery mechanism 3A. The recovery mechanism 3A has three caps to cap the nozzle faces of the print heads 5 (surfaces of the print heads in which nozzles openings are formed), i.e., in the example shown, one suction cap 31*a* as a suction cap means and two protective caps 31*b* as non-suction cap means. These caps 31*a*, 31*b*, 31*b* are held by a cap holder 32.

Only the suction cap 31*a*, which, among the three caps, is situated closest to the paper transport unit, is connected with a suction tube 34 which in turn communicates with a pump (suction pump) 35. The cap holder 32 slides along a cam groove 37*a* of the cam gear 37 to be moved up and down. The cam gear 37 is also formed with a cam groove 37*b* that cooperates with the lever 36, The cam groove 37*b* reciprocally rotates the lever 36, reciprocally driving a piston 39 of the pump 35 to draw out ink from the nozzles of the print heads.

Now, the operation of the recovery mechanisms will be described. Since the recovery mechanisms 3A, 3B, 3C, 3D perform the same way, only the recovery mechanism 3A will be taken up as a representative case in the explanation of the operation of the recovery mechanism. During a printing operation the suction cap 31*a* is open, retracted from the head capping position. FIG. 15 shows a state of the recovery mechanism corresponding to the cap open position. When the printing operation is completed, the carriage 1 moves to the home position where it halts (facing the recovery mechanism). In this condition, when a signal from the system of the apparatus drives a motor 38 of the recovery mechanism 3A forwardly, the cam gear 37 rotates in a direction of arrow a causing the cap holder 32 to move up along the cam groove 37*a*. At this time, the piston 39 is not operated. That is, no suction operation is performed as the print head is capped.

FIG. 16 shows a state of the recovery mechanism when the print head is capped.

Figure 17:
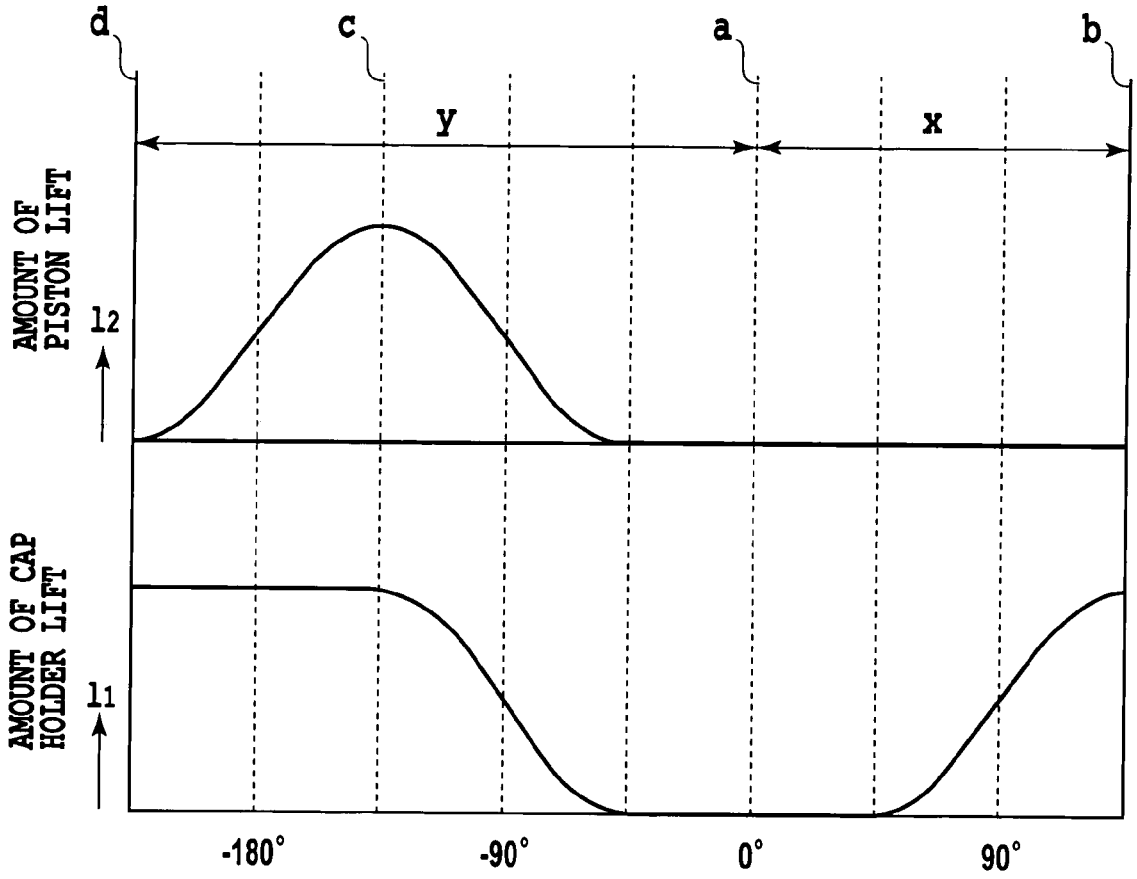
FIG. 17 is a lift diagram showing an amount of lift of a cap holder and an amount of lift of a piston with respect to a cam angle of a gear cam of the recovery mechanism.

FIG. 17 is a lift diagram showing an amount of lift of the cap holder and an amount of lift of the piston with respect to a cam angle of the gear cam in the recovery mechanism. The cam lifting action, beginning with the cap open state of FIG. 15 until the print head is capped without activating a suction operation as shown in FIG. 16, is carried out using a segment x (between a and b) of FIG. 17. In FIG. 17 a represents a cap open position and b represents a capped position.

Figure 18:
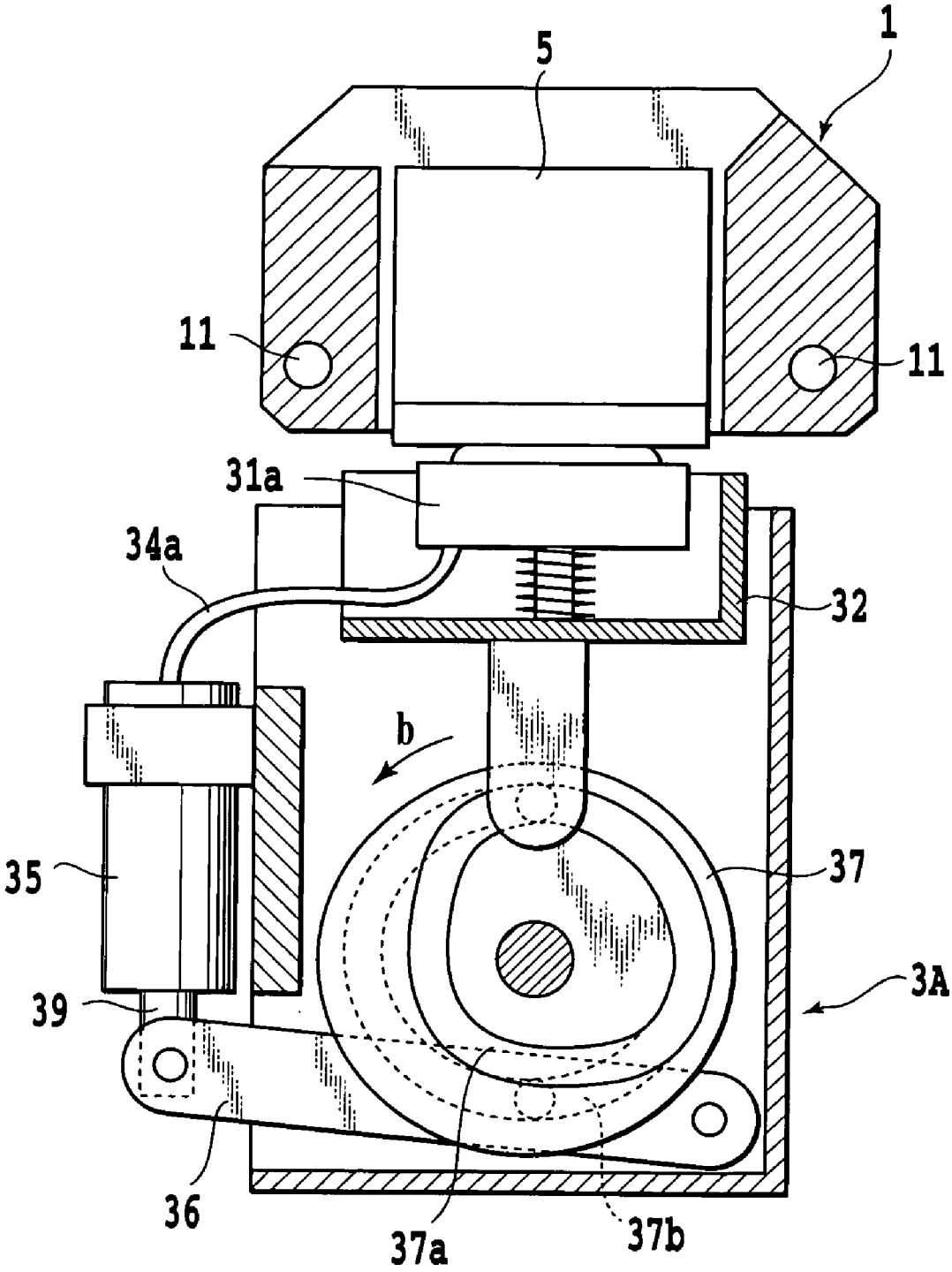
FIG. 18 is a cross-sectional view taken along the line XV—XV of FIG. 3 when the print head is capped to suck out ink.
Figure 19:
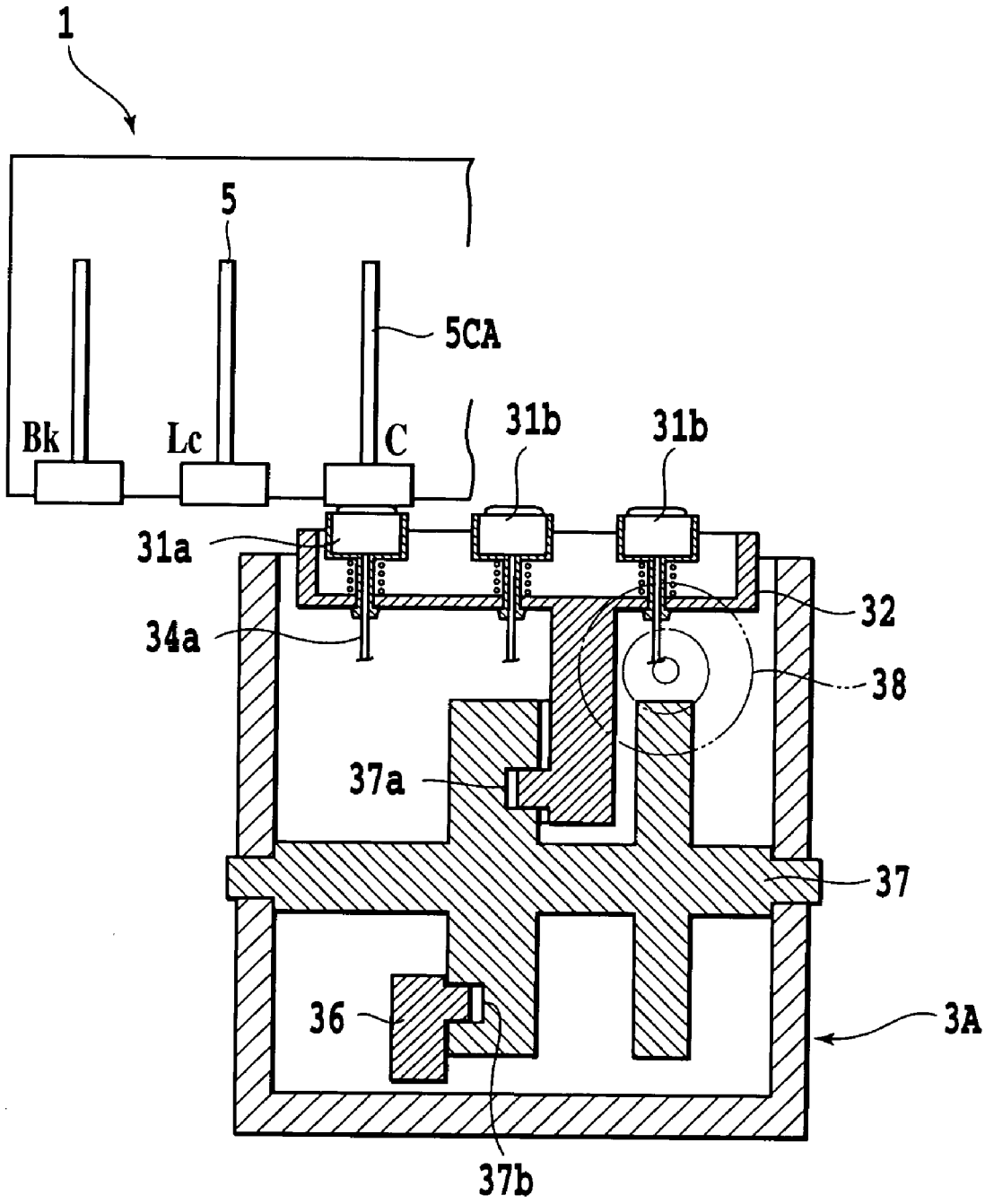
FIG. 19 is a cross-sectional view taken along the line XIV—XIV of FIG. 3 when a carriage is stopped to suck out a cyan ink.

FIG. 18 is a cross-section taken along the line XV—XV of FIG. 3 showing the recovery mechanism in a capped state for sucking out ink. FIG. 19 is a cross-section taken along the line XIV—XIV of FIG. 3 showing the recovery mechanism in a carriage halted state for sucking out a cyan ink. When an ink is to be sucked out from the print head, the carriage 1 is stopped at a position where the print head 5 to be subjected to the sucking operation faces the suction cap 31*a*. When, for example, an ink sucking operation is to be performed on the cyan head 5CA, the carriage 1 is stopped at a position where the cyan head CA aligns with the suction cap 31*a*, as shown in FIG. 19.

In this state, when the motor 38 is reversed of the rotation, the cam gear 37 is rotated in the direction of arrow b causing the cap holder 32 to move up. At the same time, the lever 36 fitted in the cam groove 37*b* formed in the side surface of the cam gear is reciprocally moved to drive the pump 35. The operation of the pump 35 draws out ink from the cyan head 5CA by suction. During this process, the cat lifting action is performed by using a segment y (between a and d) in FIG. 17. If the cam lifting action is reversed at position d to return to position a, one ink sucking operation and one idle sucking operation (an ink sucking operation with the cap open to remove residual ink on the nozzle face of the print head) are completed. Repetitively driving the cam gear between the position c and position d can perform the suction operation on the print head continually.

Such a series of operations is referred to as a suction-based recovery operation. By performing the suction-based recovery operation on each print head, substances clogging the nozzles can be removed, keeping the print head in good condition.

The necessity of the suction-based recovery operation differs between a print head protected by the suction cap and a print head protected by the protective cap. The reason for this is explained below.

Figure 20:
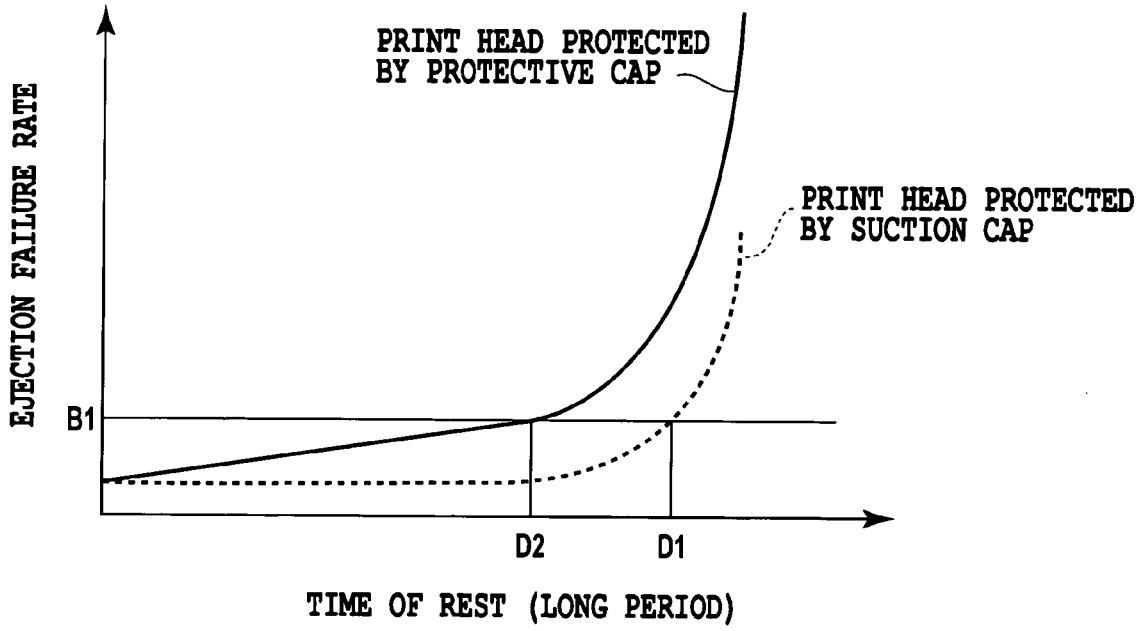
FIG. 20 is a graph showing a rate of ejection failure at idle ejections executed prior to printing after a long period of rest.
Figure 21:
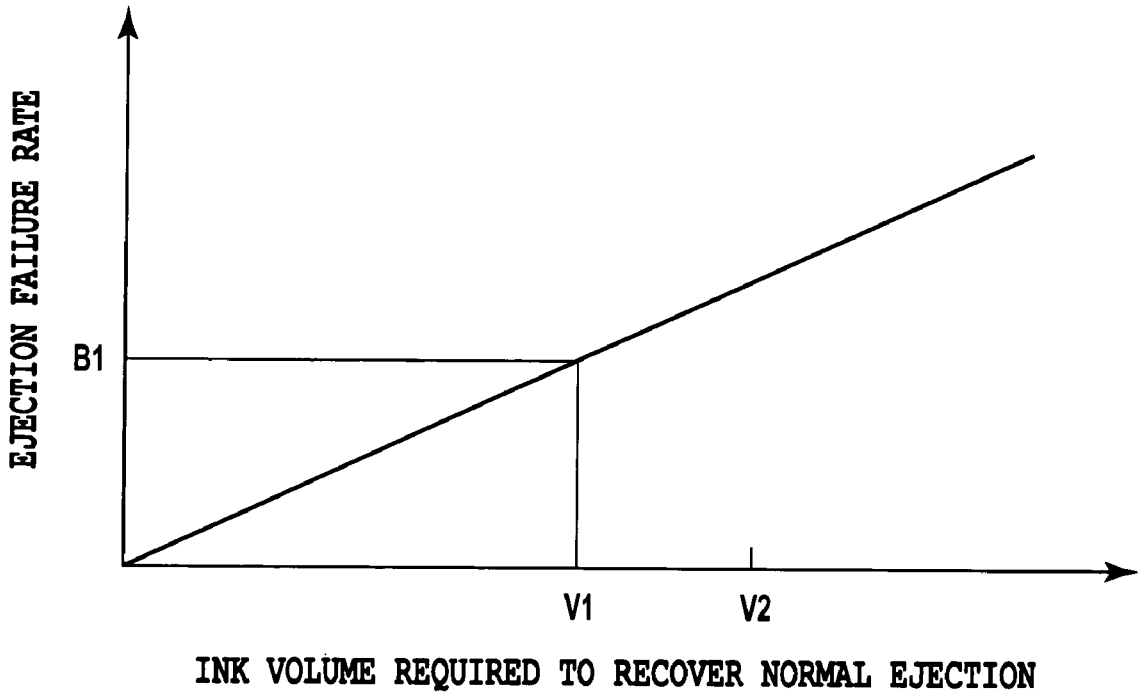
FIG. 21 is a graph showing a relation between a volume of ink required for the ejection recovery and an ejection failure rate.
Figure 22:
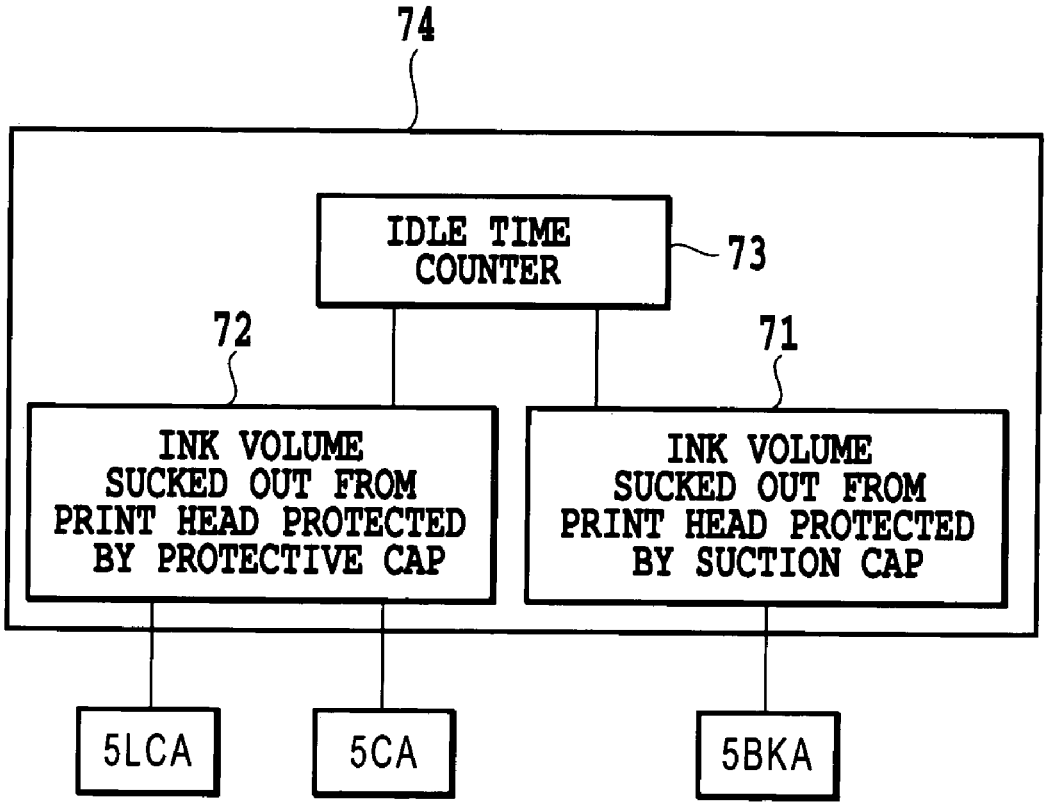
FIG. 22 is a schematic diagram showing a suction-based recovery mechanism.

FIG. 20 shows a rate of ejection failure when idle ejections are carried out prior to printing after a long period of rest, with a dashed line representing a rate of ejection failure for a print head protected by a suction cap and a solid line representing a rate of ejection failure for a print head protected by a protective cap. Since the print head protected by the protective cap evaporates a greater amount of volatile component in ink than does the print head protected by the suction cap while the print heads are left idle for a long period of time, the print head protected by the protective cap naturally has a higher rate of ejection failure. In this example, times of rest D1 and D2 are much longer than T3 and T4 of Embodiment 1, so that performing the idle ejections alone prior to printing cannot recover a normal ejection state of the nozzles.

As the rate of ejection failure rises, the volume of ink required to be sucked out of the print head in a single suction-based recovery operation also increases. That is, the volume of ink required to be sucked out is proportional to the ejection failure rate of a print head. When the ejection failure rate is less than B1, all the ejection-failed nozzles can be recovered to normal by sucking out an ink volume of V1 from the print head during the suction-based recovery operation, as shown in FIG. 20. However, when the ejection failure rate is higher than B1, not all the ejection-failed nozzles can be recovered to normal simply by sucking out the ink volume of V1 from the print head during the suction-based recovery operation. Therefore, to recover all the ejection-failed nozzles to normal requires sucking out a greater volume of ink than V1, namely V2, from the print head during the suction-based recovery operation.

As for a print head protected by a suction cap, after the print head is left unused for a period shorter than D1, which corresponds to the ejection failure rate of B1, the print head needs to be subjected to the suction-based recovery operation to suck out a volume of ink V1 from the print head to remove precipitated dyes prior to printing. If the print head is left idle for a longer period than D1, it is necessary to suck out a greater volume of ink than V1, i.e. V2, from the print head to remove precipitated dyes prior to printing. As for a print head protected by a protective cap, after the print head is left unused for a period shorter than D2, which corresponds to the ejection failure rate of B1, the print head needs to undergo the suction-based recovery operation to suck out a volume of ink V1 from the print head to remove precipitated dyes prior to printing. If the print head is left idle for a longer period than D2 and even if it is shorter than D1, it is necessary to suck out a greater volume of ink than V1, namely V2, from the print head to remove precipitated dyes prior to printing.

However, in conventional practice, the suction-based recovery operation has been performed in the same way on both print heads protected by the suction cap and by the protective cap.

In this embodiment, therefore, two separate control circuits for the suction-based recovery operation—a control circuit 71 for the print head 5BKA protected by the suction cap and a control circuit 72 for the print heads 5LCA and 5CA protected by the protective cap—are formed to realize suction-based recovery processing suited for a particular kind of print head.

The suction-based recovery operation control circuit 71 for the print head on the suction cap side, if the print head is left idle for a shorter period of time than D1, performs a suction-based recovery operation prior to printing to suck out a volume of ink V1 from the print head 5BKA protected by the suction cap. If the print head is left idle for a longer period of time than D1, the control circuit 71 performs the suction-based recovery operation prior to printing to suck out a greater volume of ink than V1, namely V2, from the print head 5BKA protected by the suction cap.

The suction-based recovery operation control circuit 72 for the print head on the protective cap side, if the print head is left idle for a shorter period of time than D2, performs a suction-based recovery operation prior to printing to suck out a volume of ink V1 from the print heads 5LCA and 5CA protected by the protective cap. If the print head is left idle for a longer period of time than D2, the control circuit 72 performs the suction-based recovery operation prior to printing to suck out a greater volume of ink than V1, namely V2, from the print heads 5LCA and 5CA protected by the protective cap.

Denoted 73 is a timer for counting a time during which the printing apparatus is left idle, i.e., the print head is not used. Based on the counted time, the control circuits 71 and 72 perform the suction-based recovery operation to suck out a volume of ink V1 if the print heads have been left idle for a shorter period of time than D1 and D2 respectively and also perform the suction-based recovery operation to suck out a volume of ink V2 if the print heads have been left idle for a longer period of time than D1 and D2 respectively.

FIG. 23 shows a relation between an idle time and a volume of ink to be sucked out. If the idle time is less than D2, the volume of ink to be sucked out is V1 for both types of print heads (print head protected by a suction cap and a print head protected by a protective cap). If the idle time is more than D2 and less than D1, the volume of ink to be sucked out is differentiated between the print head on the protective cap side and the print head on the suction cap side. This enables proper and sufficient suction-based recovery processing to be executed without having to perform more than necessary ejection operations. As a result, a wasteful consumption of ink due to unnecessary suction-based recovery operations can be avoided.

In the prior art, as shown in FIG. 24, the suction-based recovery operation following a long period of rest is performed by sucking equal volumes of ink from different types of print heads (a print head protected by a protective cap and a print head protected by a suction cap) without making any distinction between them. This results in more than necessary volume of ink being sucked out from the print head protected by the suction cap, wasting ink.

The control circuits 71 and 72 for the suction-based recovery operation may be constructed so as to set a suction force to draw out ink from the print head protected by the protective cap stronger than a suction force to draw out ink from the print head protected by the suction cap.

Further, nozzles of the print head may be cleared of foreign matters by applying pressures to the nozzles for forced discharge of ink.

(Embodiment 6)

In Embodiment 5, the amount of ink to be sucked out from a print head in the suction-based recovery operation is differentiated between a print head protected by a suction cap and a print head protected by a protective cap. The similar effect can also be produced by setting equal the amounts of ink drawn out from the two different types of print heads in a single suction-based recovery operation and differentiating the number of times that the suction-based recovery operation is executed.

In this embodiment, an example case will be explained in which the volumes of ink to be sucked out from two different types of print heads are set equal and the number of suction operations for the print head on the protective cap side is set larger.

FIG. 25 is a table showing a relation between an idle time and the number of sucking operations to be performed for each type of print head in this embodiment.

As for a print head protected by the protective cap, when the idle time is more than D2, two suction-based recovery operations are performed This is because foreign matters clogging the nozzles of the print head that cannot be removed with a single suctioned-based recovery operation can be removed with two or more suction operations. As for a print head protected by the suction cap, when the idle time is more than D2 but less than D1, only one suction-based recovery operation is performed. Differentiating the number of times that the suction-based recovery operation is performed between the print head on the protective cap side and the print head on the suction cap side in this way can subject the individual print heads to their optimum recovery processing, thereby eliminating wasteful consumption of ink due to unnecessary suction operations.

This invention is similarly applicable to any ink jet printing apparatus with a plurality of printing means and the similar effects can be produced. The applicable printing apparatus include a color printing apparatus with a plurality of printing means that use the same or different color inks, a tonal printing apparatus with a plurality of printing means that print in a single color at different densities, or a combination of these apparatus. Further, this invention can also be applied, with the similar effects, to any printing apparatus with a plurality of printing means regardless of the construction of the printing means and ink tanks. That is, it can be applied to a construction that uses a replaceable ink jet cartridge integrally incorporating printing means and ink tanks or a construction that has the printing means and ink tanks separately arranged and connects them with ink supply tubes.

As to the application to ink jet printing apparatus, this invention can also be applied to an ink jet printing apparatus whose printing means use electromechanical transducers such as piezoelectric elements. Particularly, this invention produces an excellent effect when applied to an ink jet printing apparatus with printing means that eject ink by using a thermal energy. This type of printing apparatus combined with the present invention can realize a higher density and resolution in a printed result.

As described above, in print heads protected by suction caps, their nozzle faces are more moist than those of print heads protected by protective caps and their ink degradation rate is slow. Hence, idle ejection operations are differentiated between different types of print heads so that individual print heads undergo their optimal ejection recovery processing. Thus, in a printing apparatus with a plurality of print heads, even those print heads whose nozzle faces are protected by protective caps with no suction mechanism can eliminate possible nozzle clogging and ink ejection anomalies or failures and maintain a highly reliable ejection performance without entailing a significant increase in cost or an apparatus size increase.

In the ejection recovery operation, by differentiating the number of idle ejections performed prior to initiating a printing operation, it is possible to not just avoid a wasteful ink consumption but shorten the time taken by the idle ejections.

Also in the suction-based recovery operation, differentiating the number of suction operations or ink volume to be sucked out can not only avoid a wasteful ink consumption but also maintain print heads in good condition at all times.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An ink jet printing apparatus that performs printing by ejecting ink from each of a plurality of print heads, comprising:

suction means for sucking out ink from nozzles of at least one of the print heads;

a suction cap for protecting a nozzle face of the at least one print head, said suction cap being connected to said suction means;

a protective cap for protecting a nozzle face of at least one other print head, said protective cap not being connected to said suction means; and ejection recovery means for differentiating an ejection recovery operation between the at least one print head protected by said suction cap and the at least one other print head protected by said protective cap, wherein, when a time which has elapsed from an end of a previous printing operation is within a predetermined time, said ejection recovery means sets the number of idle ejections performed by the at least one print head protected by said suction cap to be less than the number of idle ejections performed by the at least one other print head protected by said protective cap.

2. An ink jet printing apparatus that performs printing by ejecting ink from each of a plurality of print heads, comprising:

suction means for sucking out ink from nozzles of at least one of the print heads;

a suction cap for protecting a nozzle face of the at least one print head, said suction cap being connected to said suction means;

a protective cap for protecting a nozzle face of at least one other print head, said protective cap not being connected to said suction means; and ejection recovery means for differentiating an ejection recovery operation between the at least one print head protected by said suction cap and the at least one other print head protected by said protective cap, wherein, when a time which has elapsed from an end of a previous printing operation is within a predetermined time, said ejection recovery means sets a volume of ink ejected from the at least one print head protected by said suction cap to be less than a volume of ink ejected from the at least one other print head protected by said protective cap.

3. An ink jet printing apparatus that performs printing by ejecting ink from each of a plurality of print heads, comprising:

suction means for sucking out ink from nozzles of at least one of the print heads;

a suction cap for protecting a nozzle face of the at least one print head, said suction cap being connected to said suction means;

a protective cap for protecting a nozzle face of at least one other print head, said protective cap not being connected to said suction means; and ejection recovery means for differentiating an ejection recovery operation between the at least one print head protected by said suction cap and the at least one other print head protected by said protective cap, wherein, when a time which has elapsed from an end of a previous printing operation is within a predetermined time, said ejection recovery means sets a volume of ink sucked out from the at least one print head protected by said suction cap to be less than a volume of ink sucked out from the at least one other print head protected by said protective cap.

4. An ink jet printing apparatus that performs printing by ejecting ink from each of a plurality of print heads, comprising:

suction means for sucking out ink from nozzles of at least one of the print heads;

a suction cap for protecting a nozzle face of the at least one print head, said suction cap being connected to said suction means;

a protective cap for protecting a nozzle face of at least one other print head, said protective cap not being connected to said suction means; and an ejection recovery means for differentiating an ejection recovery operation between the at least one print head protected by said suction cap and the at least one other print head protected by said protective cap, wherein, when a time which has elapsed from an end of a previous printing operation is within a predetermined time, said ejection recovery means sets the number of suction operations performed on the at least one print head protected by said suction cap to be less than the number of suction operations performed on the at least one other print head protected by said protective cap.

* * * * *

UNITED STATES PATENT AND TRADEMARK OFFICE

CERTIFICATE OF CORRECTION

PATENT NO. : 7,121,645 B2
APPLICATION NO. : 10/768133
DATED : October 17, 2006
INVENTOR(S) : Hara It is certified that error appears in the above-identified patent and that said Letters Patent is hereby corrected as shown below:

COLUMN 2:
Line 7, "dry It" should read --dry. It--.

COLUMN 3:
Line 14, "comprises;" should read --comprises:--.

COLUMN 6:
Line 6, "T1; the" should read --T1, the--.

COLUMN 8:
Between Line 38 and 39, the following paragraph should be inserted --As shown in Fig. 8, the number of idle ejections is set to that of the print head on the suction cap side. It is noted, however, that when, after the printing is finished, the carriage 1 moves to the home position (where if faces the recovery mechanism), and the print head protected by the protective cap executes ejection about several hundred times toward the opposite protective cap, rather than sitting idle. This ejection gives moisture to the protective cap. No idle ejections are made to the suction cap. Within five seconds of the idle ejections, a signal from the system of the apparatus causes the cap holder 32 in the recovery mechanism 3A to move up to cap the print heads. Giving moisture to the protective cap prior to the capping action in this way can maintain the protective cap as moist as the suction cap.--.

COLUMN 10:
Line 17, "cat lifting" should read --cam lifting--.

Signed and Sealed this

Eighth Day of July, 2008

JON W. DUDAS
*Director of the United States Patent and Trademark Office*